US012502005B2

(12) United States Patent
Zeng et al.

(10) Patent No.: US 12,502,005 B2
(45) Date of Patent: Dec. 23, 2025

(54) FOOT PUMP AND INFLATABLE BED COMPRISING SAME

(71) Applicant: BESTWAY INFLATABLES & MATERIAL CORP., Shanghai (CN)

(72) Inventors: Xianglin Zeng, Shanghai (CN); Yihua You, Shanghai (CN); Qingshui Song, Shanghai (CN); Bingrong Wu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 172 days.

(21) Appl. No.: 18/126,811

(22) Filed: Mar. 27, 2023

(65) Prior Publication Data

US 2024/0108150 A1 Apr. 4, 2024

(30) Foreign Application Priority Data

Sep. 29, 2022 (CN) ..... 202222596371.3

(51) Int. Cl.
*A47C 27/08* (2006.01)
*F04B 33/00* (2006.01)

(52) U.S. Cl.
CPC ..... *A47C 27/081* (2013.01); *F04B 33/00* (2013.01)

(58) Field of Classification Search
CPC ... A47C 27/081; A47C 27/144; A47C 27/084; F04B 33/00; F04B 39/10; F04B 45/02
(Continued)

(56) References Cited

U.S. PATENT DOCUMENTS 3,155,991 A * 11/1964 Dunham ..... A47C 27/084 5/709
4,579,141 A * 4/1986 Arff ..... B63C 9/24 251/86

(Continued)

FOREIGN PATENT DOCUMENTS

CN 2584049 Y 11/2003
CN 1491819 4/2004

(Continued)

OTHER PUBLICATIONS

Extended European Search Report dated 04.12.2023 (Dec. 4, 2023), 8 pages, issued on related European Patent Application 23166333.7 by the European Patent Office.

(Continued)

*Primary Examiner* — David R Hare
*Assistant Examiner* — George Samuel Gines
(74) *Attorney, Agent, or Firm* — Dickinson Wright PLLC

(57) ABSTRACT

A foot pump includes a pump cavity and an air outlet is provided in a sidewall of the pump cavity. The pump cavity is in fluid communication with the inflatable body through the air outlet. An air inlet valve seat is provided at the top of the pump cavity, wherein the air inlet valve seat comprises an air inlet. A diaphragm valve is provided at the air inlet, and the diaphragm valve is arranged inside the pump cavity to allow the air inlet to switch between an open state and a closed state. An elastic return component is provided inside the pump cavity, wherein a first end of the elastic return component abuts against the bottom of the pump cavity, and a second end of the elastic return component abuts against the air inlet valve seat. An inflatable bed including the foot pump is also provided.

18 Claims, 3 Drawing Sheets

(58) Field of Classification Search
USPC ..... 5/708
See application file for complete search history.

(56) References Cited

U.S. PATENT DOCUMENTS

| | | | | |
|---|---|---|---|---|
| 6,135,143 | A * | 10/2000 | Po | F16K 15/1821 137/512.15 |
| 7,992,588 | B2 * | 8/2011 | Song | F16K 15/202 251/149.2 |
| 8,584,695 | B2 | 11/2013 | Lau | |
| 2008/0047072 | A1 | 2/2008 | Chang et al. | |

FOREIGN PATENT DOCUMENTS

| | | | | |
|---|---|---|---|---|
| CN | 2660165 | Y | 12/2004 | |
| CN | 107013434 | A * | 8/2017 | F04B 33/00 |
| CN | 210446352 | U * | 5/2020 | A47C 27/081 |
| DE | 4034593 | | 7/1992 | |
| GB | 708759 | | 5/1954 | |
| WO | WO-2021205203 | A1 * | 10/2021 | |

OTHER PUBLICATIONS

Notice of Acceptance of Request for Invalidation dated Mar. 11, 2025 (Mar. 11, 2025), 25 pages, issued on related granted Chinese Patent CN218816827, issued by the Chinese State Intellectual Property Office (Chinese Version), part 1 of 2.

Notice of Acceptance of Request for Invalidation dated Mar. 11, 2025 (Mar. 11, 2025), 25 pages, issued on related granted Chinese Patent CN218816827, issued by the Chinese State Intellectual Property Office (English Version), part 2 of 2.

Office Action regarding corresponding EP App. No. 23 166 333.7; issued Sep. 15, 2025.

* cited by examiner

FOOT PUMP AND INFLATABLE BED COMPRISING SAME

CROSS-REFERENCE TO RELATED APPLICATION

This application claims priority from Chinese Application CN202222596371.3, filed Sep. 29, 2022 in China, the disclosure of which is incorporated herein by reference in its entirety.

BACKGROUND

1. Field

Apparatuses and methods consistent with example embodiments relate to the field of inflatable beds, and in particular to a foot pump and an inflatable bed comprising the foot pump.

2. Description of the Related Art

With the development of society and the improvement of people's living standards, inflatable beds have become popular because of their light weight, ease of use, comfort, and adjustable softness. Inflatable beds are widely used in various fields such as leisure and entertainment, medical health care, and home life. One of two types of inflation pumps is used for inflation of an inflatable bed: a built-in pump or an external pump. An external inflation pump is inconvenient to carry, and a built-in inflation pump is easy to use. However, in existing, traditional, built-in foot pumps, part of the air in a foot pump cavity is separated from an air inlet during inflation, which leads in poor inflation efficiency and the requirement of a lot of pedaling to inflate a bed.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, a foot pump configured for use with an inflatable body comprises: a pump cavity and an air outlet disposed in a sidewall of the pump cavity, such that the air outlet provides fluid communication between the pump cavity and the inflatable body external to the pump cavity; an air inlet valve seat disposed at a top of the pump cavity, the air inlet valve seat comprising an air inlet; a diaphragm valve disposed at the air inlet, wherein the diaphragm valve is disposed inside the pump cavity and is deformable between an open state in which the air inlet provides fluid communication between the pump cavity and an exterior environment and a closed state in which the diaphragm valve blocks the air inlet; and an elastic return component disposed inside the pump cavity and comprising a first end which abuts against a bottom of the pump cavity, and a second end which abuts against the air inlet valve seat.

In the closed state, the diaphragm valve may contact a valve wall of the air inlet valve seat; and in the open state, the diaphragm valve may be deformed and may be separated from the valve wall.

The diaphragm valve may be made of a flexible material.

The diaphragm valve may comprise a connection structure connecting the diaphragm valve to the valve wall, and a position of the connection structure relative to the valve wall remains unchanged during deformation of the diaphragm valve between the open state and the closed state.

The connection structure may comprise a diaphragm valve rod passing through the air inlet and a fastener engaged with an upper surface of the valve wall of the air inlet valve seat in a first direction.

The air inlet valve seat may further comprise an air inlet channel comprising the air inlet; the diaphragm valve rod is partially disposed in the air inlet channel; and the fastener is disposed in the air inlet channel.

The fastener may be conical and disposed on the diaphragm valve rod, such that the fastener and the diaphragm valve are respectively located on opposite sides of the air inlet in the first direction.

The foot pump may further comprise: an inflation nozzle disposed outside the pump cavity and covering the air outlet, wherein the air outlet port is in fluid communication with the inflation nozzle.

The elastic return component may comprise a spring.

According to an aspect of another example embodiment, an inflatable bed comprises: an air chamber defined by an air chamber wall; and a foot pump as described above.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
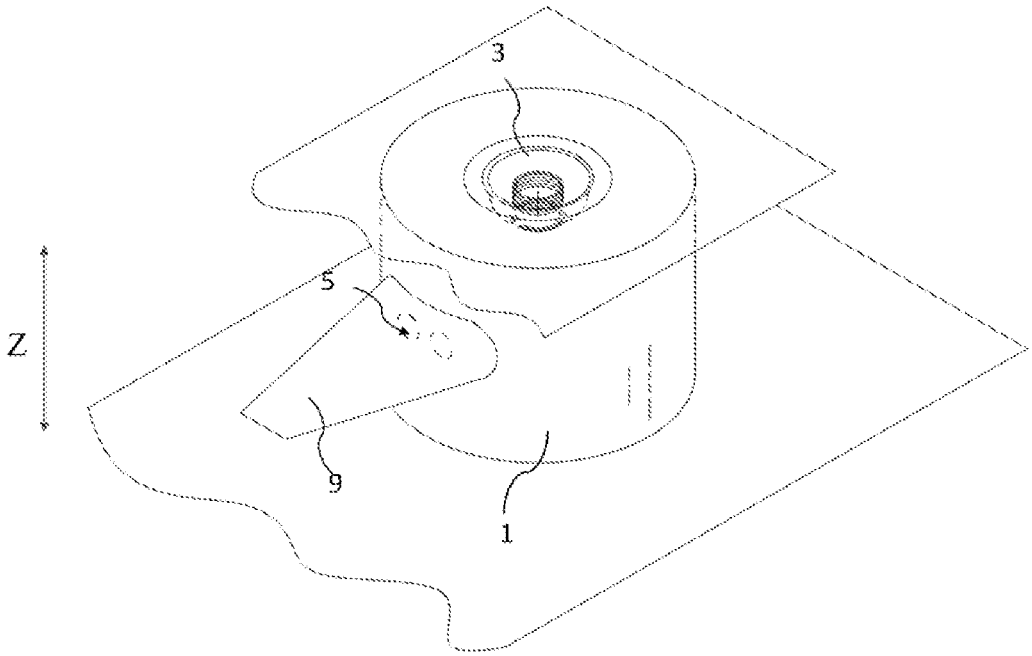
FIG. 1 is a perspective view of a foot pump according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including," "comprise," and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items.

Expressions such as "at least one of" when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

It should be noted that orientations and relative positional relationships indicated by terms such as "upper", "lower", "inner," and "outer" are based on orientations or relative positional relationships as shown in the drawings or the orientations or relative positional relationships in which a product is customarily placed in use, which is only for convenience of description, rather than indicating or implying that devices or elements referred to must have a specific orientation or be constructed and operated in the specific orientation, and therefore cannot be construed as limiting.

It should also be noted that the terms "setup", "connected", and "connection" should be understood in a broad sense, unless otherwise explicitly specified and limited. For example, a connection can be a fixed connection, a detachable connection, or integrated connection; may be a mechanical connection or an electrical connection; and may be a direct connection, an indirect connection via an intermediate medium, or internal communication between two elements. For those of ordinary skill in the art, the specific meaning of the terms mentioned above should be understood in specific situations.

Figure 2:
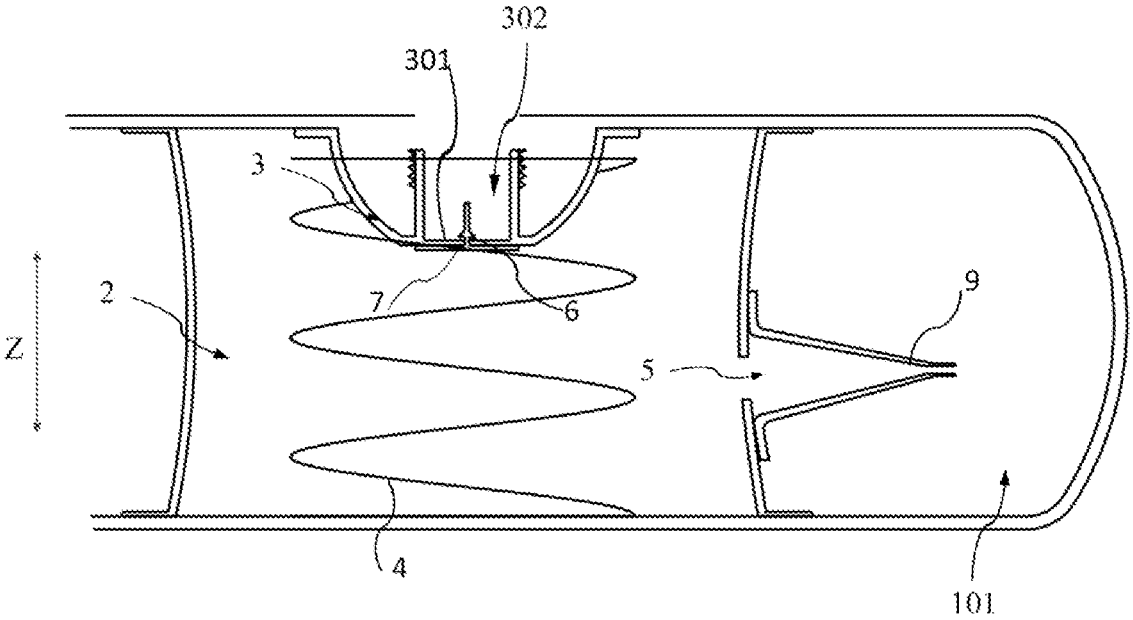
FIG. 2 is a sectional view of the foot pump of FIG. 1.

FIGS. 1-2 illustrate an example embodiment including: a foot pump 1 arranged on an inflatable body for inflating the inflatable body and comprising a pump cavity 2, wherein an air outlet 5 is provided in a sidewall of the pump cavity 2, and the pump cavity 2 is in fluid communication with the inflatable body through the air outlet 5. The air outlet 5 may take the form of a circular hole leading from an inner side of the sidewall of the pump cavity 2 to an outer side of the sidewall of the pump cavity 2. An air inlet valve seat 3 is provided on the top of the pump cavity 2 (for example, in a position convenient for a user's foot to step on) and comprises an air inlet 6. A diaphragm valve 7 is provided at the air inlet 6, and the diaphragm valve 7 is arranged inside the pump cavity 2 to allow the air inlet 6 to switch between an open state and a closed state. As an example, the air inlet valve seat 3 may be welded to the top of the pump cavity 2, the diaphragm valve 7 may take the form of a sheet, and, in an initial state, the diaphragm valve 7 may cover the air inlet 6. An elastic return component 4 is provided inside the pump cavity 2 and abuts against the bottom of the pump cavity 2 at one end, while abutting against the air inlet valve seat 3 at the other end.

Figure 3:
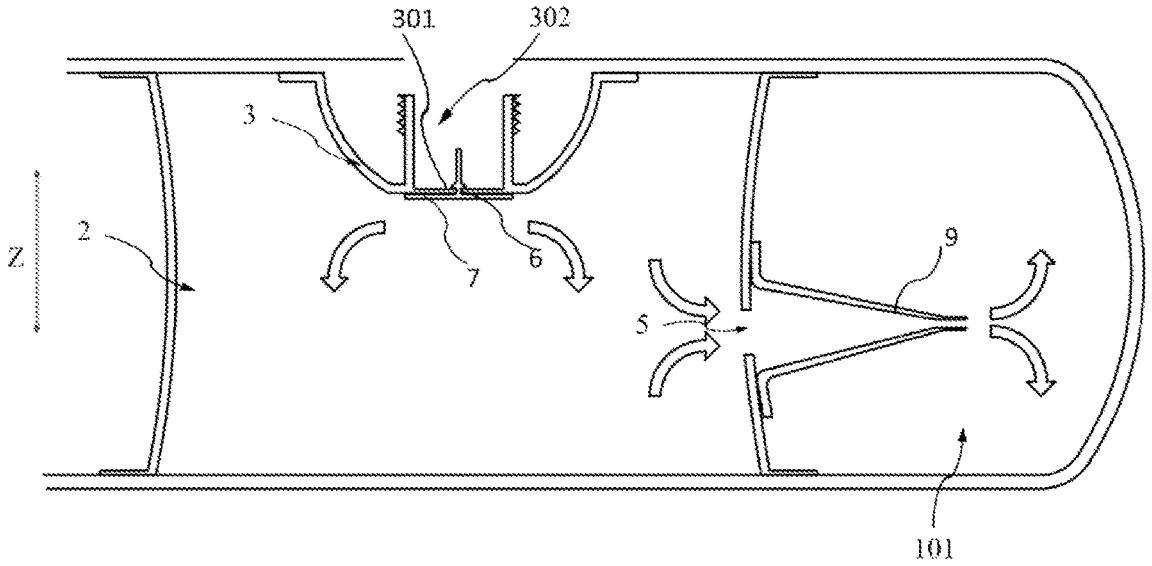
FIG. 3 is a schematic diagram of a diaphragm valve in a closed state, according to an example embodiment.
Figure 4:
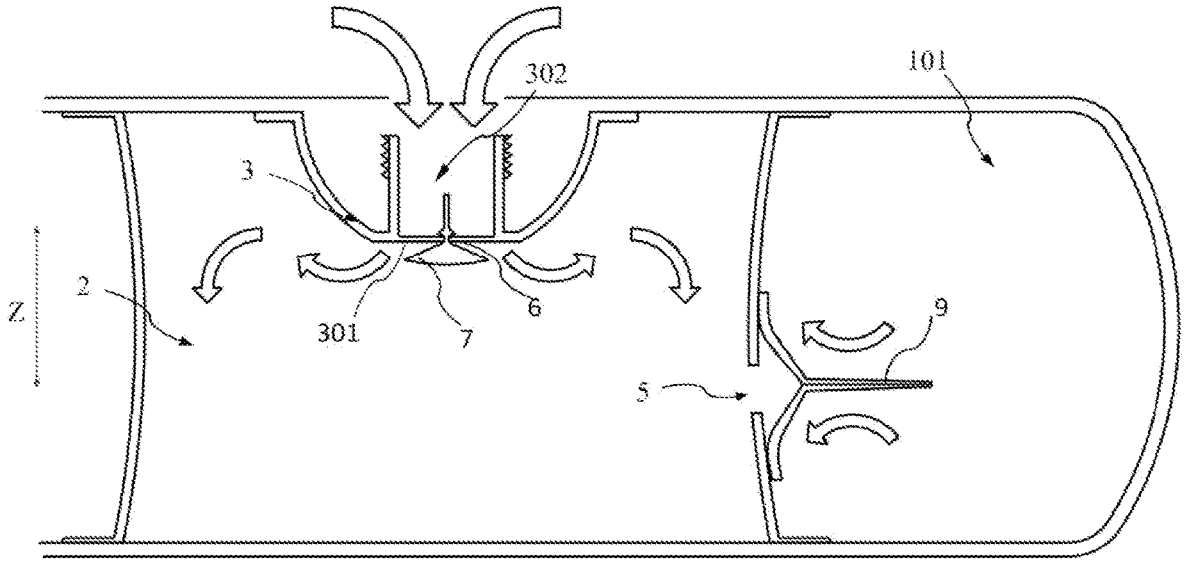
FIG. 4 is a schematic diagram of a diaphragm valve in an open state, according to an example embodiment.

As an example, referring to FIGS. 3-4, when the pump cavity 2 is compressed under a pressure from a foot, that is, an external force is applied to the foot pump 1, the diaphragm valve 7 is closed (as shown in FIG. 3). Thus, the air inlet 6 is in the closed state; the air inlet 6 is not in communication with the pump cavity 2; the inflatable body (such as an air chamber of an inflatable bed) can be inflated through the air outlet 5; and the air in the pump cavity 2 can only exit through the air outlet 5 to thereby inflate the inflatable body and cannot escape through the air inlet 6. When the pump cavity 2 restores, that is, when the external force is removed, the diaphragm valve 7 is opened (as shown in FIG. 4). Thus, the air inlet 6 is in the open state, and the air inlet 6 is in communication with the pump cavity 2, such that outside air passes through the air inlet 6 and flows through the diaphragm valve 7 into the pump cavity 2.

With reference to FIGS. 2-4, during inflation, a user places their foot on the foot pump and steps down, such that the elastic return component 4 is subjected to an external force and is compressed toward the bottom of the pump cavity 2. In this case, the diaphragm valve 7 is closed (as shown in FIG. 3); the air inlet 6 is in the closed state; and the air in the pump cavity 2 can only enter the inflatable body (such as the air chamber of the inflatable bed) through the air outlet 5 and cannot flow out through the air inlet 6 via the diaphragm valve 7, so as to achieve the purpose of efficiently inflating the inflatable body. With the provision of the diaphragm valve 7, when the user steps down on the foot pump, the diaphragm valve 7 is closed, which effectively prevents the air in the pump cavity 2 from overflowing from the air inlet 6, thereby improving an efficiency of inflation.

When the user lifts their foot, that is, when the external force is removed, the elastic return component 4 returns toward the air inlet valve seat 3. In this case, the diaphragm valve 7 is opened (as shown in FIG. 4). Thus, air inlet 6 is in the open state, and under the effect of the elastic return component 4, the pump cavity 2 restores, and the outside air flows from the air inlet 6 into the pump cavity 2 via the diaphragm valve 7. Then, the user steps down again, and the air in the pump cavity 2 enters the inflatable body again, and this operation is repeated to inflate the inflatable body.

As an example, the elastic return component 4 may extend spirally from the bottom of the pump cavity 2 to the air inlet valve seat 3. According to one or more example embodiments, referring to FIG. 2, the elastic return component 4 may be a spring. The elastic return component 4 can be compressed under an external force (e.g., the pressure from the foot of the user), such that the air in the pump cavity 2 inflates the inflatable body (for example, the air chamber of the inflatable bed) through the inflation nozzle 9 described hereinafter. After stopping the application of the external force, the elastic return component 4 returns, and the outside air enters the air inlet channel 302 and thus enters the pump cavity 2.

According to one or more example embodiments, referring to FIG. 3, when the air inlet 6 is in the closed state, the diaphragm valve 7 is attached to a valve wall 301 of the air inlet valve seat 3, and the diaphragm valve 7 is in the shape of a sheet, i.e. substantially planar. Referring to FIG. 4, when the air inlet 6 is in the open state, the diaphragm valve 7 deforms and is separated from the valve wall 301, and the diaphragm valve 7 becomes substantially conical. As an example, referring to FIG. 3, when the diaphragm valve 7 is attached to the valve wall 301, the air inlet 6 is blocked by the diaphragm valve 7, such that the air cannot flow out from the air inlet 6, thereby avoiding leakage of the air. Referring to FIG. 4, when the diaphragm valve 7 is separated from the valve wall 301, the air flows out at the separation between the diaphragm valve 7 and the valve wall 301 and enters the pump cavity 2, thereby collecting air from the outside.

According to one or more example embodiments, the diaphragm valve 7 may be made of a flexible material. As an example, referring to FIG. 4, as the diaphragm valve 7 is made of a flexible material, the diaphragm valve 7 can deform under the impact of the air, and the diaphragm valve 7 can deform into a substantially conical shape (as shown in FIG. 4) for the air to flow into the pump cavity 2.

Figure 5:
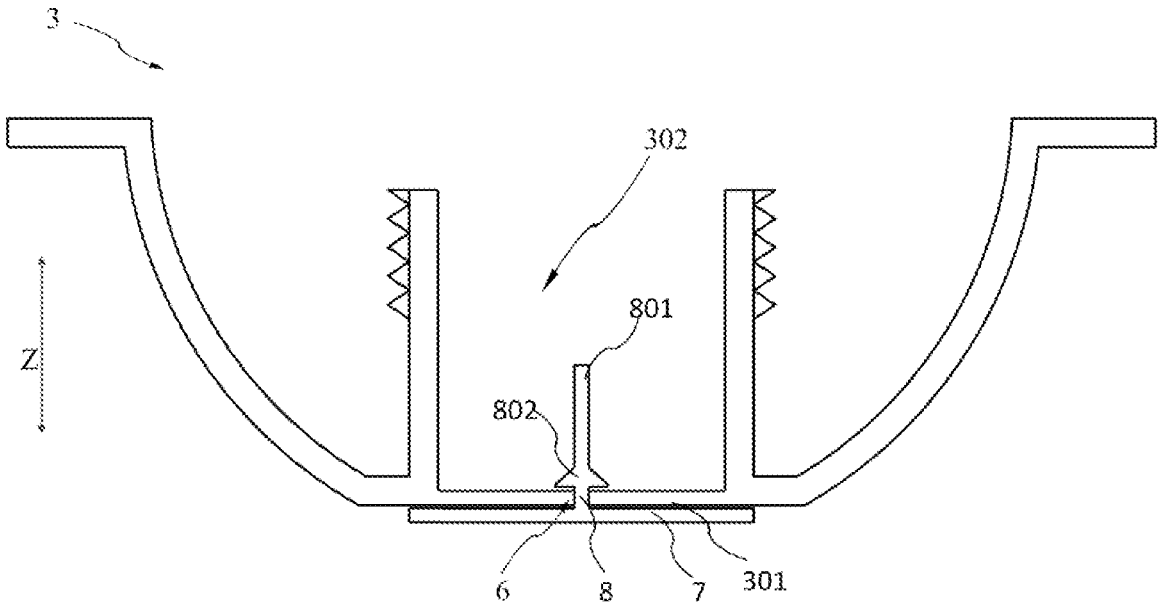
FIG. 5 is an enlarged view of an air inlet valve seat, according to an example embodiment.

According to one or more example embodiments, referring to FIGS. 3-5, the diaphragm valve 7 may comprise a connection structure 8, such that the diaphragm valve 7 is connected to the valve wall 301 by the connection structure 8, and the position of the connection structure 8 relative to the valve wall 301 remains unchanged during switching of the diaphragm valve 7 between the open state and closed state. As an example, referring to FIG. 5, the diaphragm valve 7 may be fixed by the connection structure 8 at the air inlet 6, and the entry and exit of the air at the air inlet 6 can be controlled by the opening and closing of the diaphragm valve 7. Regardless of whether the diaphragm valve 7 is in the open state or the closed state, the position of the connection structure 8 may remain unchanged, and further, the position of the diaphragm valve 7 also remains unchanged, such that the entry and exit of the air are controlled to avoid air leakage potentially caused by a change of the position of the diaphragm valve 7.

According to one or more example embodiments, referring to FIG. 5, the connection structure 8 comprises a diaphragm valve rod 801 and a fastener 802, wherein the diaphragm valve rod 801 passes through a hole in the air inlet 6, and the fastener 802 is engaged with an upper surface of the valve wall 301 in a first direction (the Z direction as shown in FIG. 5). As an example, the diaphragm valve rod 801 may be substantially columnar, and a lowermost end of the diaphragm valve rod 801 in the first direction is connected to the diaphragm valve 7, the diaphragm valve rod 801 passes through the air inlet 6 and moves upwards in the first direction and toward the air inlet valve seat 3, until the diaphragm valve 7 contacts a lower surface of the valve seat 301 in the first direction, and the diaphragm valve 7 is fixed thereto to realize the control of air entry and exit.

According to one or more example embodiments, referring to FIG. 5, the air inlet valve seat 3 further comprises an air inlet channel 302, wherein the air inlet channel 302 includes the air inlet 6, the diaphragm valve rod 801 is partially located in air inlet channel 302, and the fastener 802 is located in the air inlet channel 302. As an example, the diaphragm valve rod 801 may extend through the air inlet 6 into the air inlet channel 302, one end of the air inlet channel 302 may be in communication with the outside environment, such that the outside air can enter the air inlet valve seat 3 through the air inlet channel 302, and the other end of the air inlet channel 302 may be in communication with the air inlet 6 for circulation of the air.

According to one or more example embodiments, referring to FIG. 5, the fastener 802 may be substantially conical, the fastener 802 may be located on the diaphragm valve rod 801, and the fastener and the diaphragm valve 7 may be disposed on opposite sides of the air inlet 6 in the first direction (the Z direction as shown in FIG. 5). As an example, the fastener 802 may be a cone located on the diaphragm valve rod 801, and may be engaged with the upper surface of the valve wall 301 in the first direction, that is, the fastener 802 may be fixed on the upper surface of the valve wall 301 in the first direction. Further, the diaphragm valve 7 may be fixed on the lower surface of the valve wall 301 in the first direction, that is, the fastener 802 has the functions of fixing and connecting, such that the diaphragm valve 7 is fixed to better control the entry and exit of the air.

According to one or more example embodiments, referring to FIG. 1, an inflation nozzle 9 is further provided outside the pump cavity and covers the air outlet 5, and the air outlet port 5 is in communication with the inflation nozzle 9. As an example, the inflation nozzle 9 may be flared and may be welded to the outer wall of the pump cavity, two air outlet 5 may be provided, and the air in the pump cavity may enter the inflation nozzle 9 through the air outlet 5 and then enter the inflatable body (for example, the air chamber of the inflatable bed) from the inflation nozzle 9 to achieve the purpose of inflating the inflatable body.

As an example, referring to FIG. 4, the inflation nozzle 9 may be made of a flexible material, and will be closed when the air flows back to prevent the air from flowing back into the pump cavity 2.

With reference to FIGS. 3-4, when a user steps down on the foot pump in the first direction (the Z direction as shown in FIG. 3), the diaphragm valve 7 is closed, the inflation nozzle 9 is opened, and the air in the pump cavity 2 enters the inflation nozzle 9 through the air outlet 5 and then enters the inflatable body (for example, the air chamber of the inflatable bed) to inflate the inflatable body. When the user lifts their foot, the diaphragm valve 7 is opened, the outside air first enters the air inlet channel 302 and then enters the pump cavity 2 through the air inlet 6, and at this time, the inflation nozzle 9 is closed to prevent the air flowing into the inflatable body from flowing back into the pump cavity 2.

Figure 6:
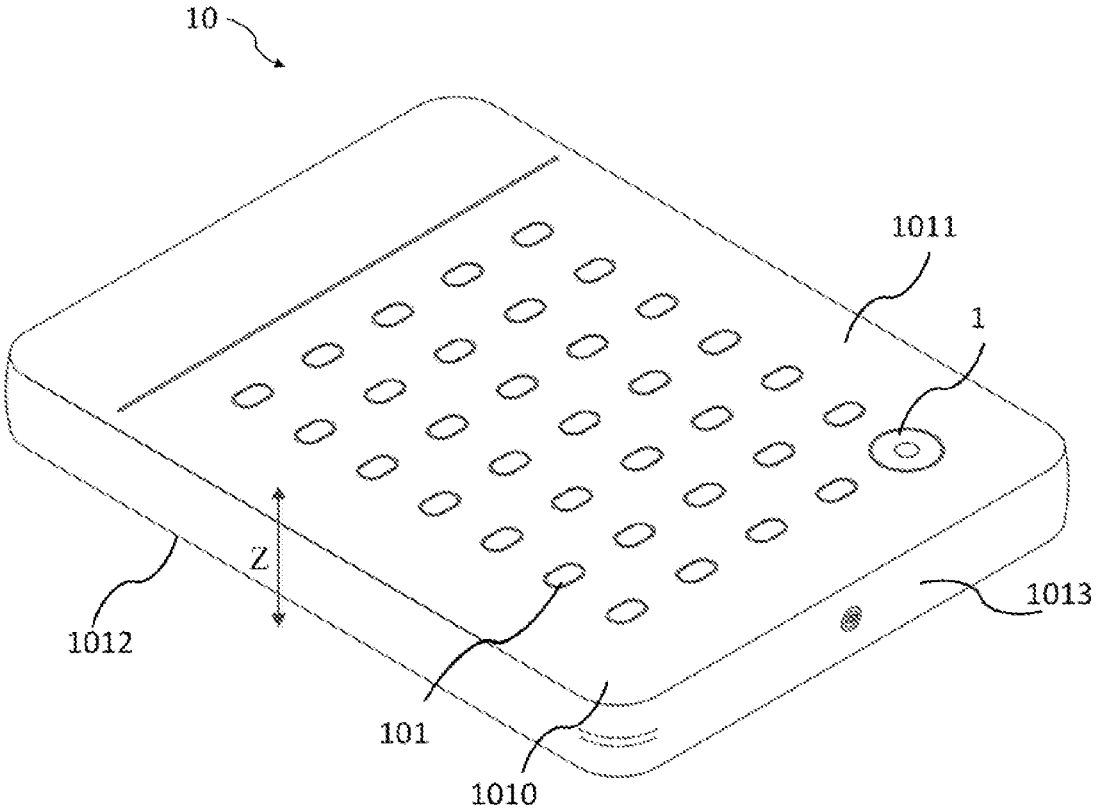
FIG. 6 is a perspective view of an inflatable bed with a foot pump therein, according to an example embodiment.

Referring to FIG. 6, one or more example embodiments may provide an inflatable bed 10 including the above-mentioned foot pump 1. The inflatable bed comprises an air chamber 101 and the foot pump 1. The air chamber 101 is defined by an air chamber wall 1010. As shown in FIG. 6, the air chamber wall 1010 comprises an upper sheet wall 1011, a lower sheet wall 1012, and a side enclosure wall 1013. The foot pump 1 is disposed in the air chamber wall 1010. According to one or more example embodiments, the top of the foot pump 1 may be welded to the upper sheet wall 1011 of the air chamber 101, or the top of the foot pump 1, and the upper sheet wall 1011 of the air chamber 101 may be made of a single piece of material. The bottom of the foot pump 1 may be welded to the lower sheet wall 1012 of the air chamber 101, or the bottom of the foot pump 1, and the lower sheet wall 1012 of the air chamber 101 may be made of a single piece of material.

According to one or more example embodiments, the air in the pump cavity can enter the air chamber 101 of the inflatable bed 10 by means of a user stepping on the foot pump 1 to achieve the purpose of inflating the inflatable bed 10. Moreover, with the provision of the diaphragm valve, when the user steps down on the foot pump 1, the diaphragm valve is closed, which can prevent the air in the pump cavity from overflowing from the air inlet, thereby improving the efficiency of inflation of the inflatable bed 10.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. A foot pump configured for use with an inflatable body and comprising:

a sidewall forming a pump cavity;

an inflation nozzle made of flexible material and welded to the sidewall an air inlet valve seat disposed at a top of the pump cavity and comprising an air inlet;

a diaphragm valve disposed at the air inlet;

an elastic return component disposed inside the pump cavity and comprising:

a first end abutting against the bottom of the pump cavity;

a second end abutting against the top of the pump cavity;

wherein the air inlet provides fluid communication between the pump cavity and an exterior environment; the at least one air outlet provides fluid communication between the pump cavity and the inflatable body; and wherein the sidewall includes at least two air outlets that each extend from an inner side of the sidewall through an outer side of the sidewall, and the inflation nozzle is positioned outside the pump cavity and covers the at least two air outlets.

2. The foot pump of claim 1, wherein the diaphragm valve is made of a flexible material.

3. The foot pump of claim 1, wherein:

the diaphragm valve comprises a connection structure connecting the diaphragm valve to the valve wall.

4. The foot pump of claim 3, wherein:

the connection structure comprises a diaphragm valve rod passing through the air inlet and a fastener engaged with an upper surface of the valve wall of the air inlet valve seat in a first direction.

5. The foot pump of claim 4, wherein:

the air inlet valve seat further comprises an air inlet channel comprising the air inlet;

the diaphragm valve rod is partially disposed in the air inlet channel; and the fastener is disposed in the air inlet channel.

6. The foot pump of claim 5, wherein:

the fastener is conical and disposed on the diaphragm valve rod, such that the fastener and the diaphragm valve are respectively located on opposite sides of the air inlet in the first direction.

7. The foot pump of claim 1, wherein the elastic return component comprises a spring.

8. An inflatable bed, comprising:

air chamber defined by an air chamber wall; and a foot pump disposed on the air chamber wall, the foot pump comprising:

a sidewall forming a pump cavity;

an inflation nozzle made of flexible material and welded to the sidewall;

an air inlet valve seat disposed at a top of the pump cavity and comprising an air inlet, a diaphragm valve disposed at the air inlet;

an elastic return component disposed inside the pump cavity and comprising:

a first end abutting against the bottom of the pump cavity;

a second end abutting against the top of the pump cavity;

wherein the air inlet provides fluid communication between the pump cavity and an exterior environment; the at least one air outlet provides fluid communication between the pump cavity and the inflatable body; and wherein the sidewall includes at least two air outlets that each extend from an inner side of the sidewall through an outer side of the sidewall, and the inflation nozzle is positioned outside the pump cavity and covers the at least two air outlets.

9. The inflatable bed of claim 8, the diaphragm valve is made of a flexible material.

10. The inflatable bed of claim 8 wherein:

the diaphragm valve comprises a connection structure connecting the diaphragm valve to the valve wall.

11. The inflatable bed of claim 10, wherein:

the connection structure comprises a diaphragm valve rod passing through the air inlet and a fastener engaged with an upper surface of the valve wall of the air inlet valve seat in a first direction.

12. The inflatable bed of claim 11, wherein:

the air inlet valve seat further comprises an air inlet channel comprising the air inlet;

the diaphragm valve rod is partially disposed in the air inlet channel; and the fastener is disposed in the air inlet channel.

13. The inflatable bed according to claim 12, wherein:

the fastener is conical and disposed on the diaphragm valve rod, such that the fastener and the diaphragm valve are respectively located on opposite sides of the air inlet in the first direction.

14. The inflatable bed according to claim 8, wherein the elastic return component comprises a spring.

15. The foot pump of claim 1, wherein the inflation nozzle is deformable between an open state and a closed state; in the open state, the pump cavity is in fluid communication with the inflatable body through the at least one air outlet; in the closed state, the inflation nozzle blocks the at least one air outlet.

16. The foot pump of claim 15, wherein, in the open state, the inflation nozzle is flared; in the closed state, the inflation nozzle is closed to prevent the air from flowing back into the pump cavity.

17. The inflatable bed of claim 8, wherein the inflation nozzle is deformable between an open state and a closed state; in the open state, the pump cavity is in fluid communication with the inflatable body through the at least one air outlet; in the closed state, the inflation nozzle blocks the at least one air outlet.

18. The inflatable bed of claim 17, wherein, in the open state, the inflation nozzle is flared; in the closed state, the inflation nozzle is closed to prevent the air from flowing back into the pump cavity.

* * * * *